United States Patent [19]

Maglica

[11] Patent Number: 4,851,974

[45] **Date of Patent: * Jul. 25, 1989**

[54] FLASHLIGHT

[75] Inventor: Anthony Maglica, Ontario, Calif.

[73] Assignee: Mag Instrument, Inc., Ontario, Calif.

[ * ] Notice: The portion of the term of this patent subsequent to Mar. 18, 2003 has been disclaimed.

[21] Appl. No.: 177,866

[22] Filed: Mar. 23, 1988

Related U.S. Application Data

[63] Continuation of Ser. No. 34,845, Apr. 6, 1987, abandoned, which is a continuation of Ser. No. 836,975, Mar. 6, 1986, Pat. No. 4,656,565, and a continuation-in-part of Ser. No. 648,032, Sep. 6, 1984, Pat. No. 4,577,263.

[51] Int. Cl.[4] ..... F21L 7/00; F21V 23/04

[52] U.S. Cl. ..... 362/187; 362/197; 362/205

[58] Field of Search ..... 362/187, 188, 203, 205

[56] References Cited

U.S. PATENT DOCUMENTS

| | | | |
|---|---|---|---|
| 1,638,716 | 8/1927 | Surles | 362/205 |
| 1,674,650 | 6/1928 | Leser | 362/188 |
| 1,758,835 | 5/1930 | Hime | 362/205 |
| 2,176,301 | 10/1939 | Haas | 362/158 |
| 2,339,356 | 1/1944 | Sachs | 362/187 |
| 2,530,913 | 11/1950 | Shackel | 362/205 |
| 4,151,583 | 4/1979 | Miller | 362/205 |
| 4,472,766 | 9/1984 | Hung | 362/205 X |
| 4,568,336 | 4/1987 | Maglica | 362/205 X |
| 4,577,263 | 3/1986 | Maglica | 362/187 |
| 4,656,565 | 4/1987 | Maglica | 362/187 |

*Primary Examiner*—Tony M. Argenbright
*Attorney, Agent, or Firm*—Lyon & Lyon

[57] ABSTRACT

A flashlight includes a barrel for retaining batteries. A reflector and lens located at one end is rotatable axially to vary the reflection dispersion of a light beam emanating through the lens from a lamp bulb. An internal cylindrical sleeve within the barrel provides the electrical path between a tail cap adjacent the one electrode end of the batteries and the end adjacent the reflector, lens, and bulb. The sleeve is a nonferrous nickel plated material for improved conductivity between component parts.

9 Claims, 2 Drawing Sheets

FLASHLIGHT

RELATED APPLICATION

This application is a continuation of U.S. Ser. No. 034,845 filed Apr. 6, 1987, now abandoned, which is a continuation of U.S. Ser. No. 836,975 filed Mar. 6, 1986, now U.S. Pat. No. 4,656,565 which is a continuation-in-part of U.S. Ser. No. 648,032 filed Sept. 6, 1984, now U.S. Pat. No. 4,577,263, the contents of which are incorporated by reference herein.

BACKGROUND OF THE INVENTION

The present invention relates primarily to flashlights, and in particular, to a miniature hand-held flashlight.

Flashlights of varying sizes and shapes are well-known in the art. In particular, certain of such known flashlights utilize two or more dry cell batteries, carried in series in a cylindrical tube serving as a handle for the flashlight, as their source of electrical energy. Typically, an electrical current is established from one electrode of the battery through a conductor to a switch, then through a conductor to one electrode of the lamp bulb. After passing through the filament of the lamp bulb, the electrical circuit emerges through a second electrode of the lamp bulb in electrical contact with a conductor, which in turn is in electrical contact with the flashlight housing. The flashlight housing usually provides an electrical conduction path to an electrical conductor, generally a spring element, in contact with the other electrode of the battery. Actuation of the switch to complete the electrical circuit enables electrical current to pass through the filmament, thereby generating light which is typically focused by a reflector to form a beam of light. The production of light from such flashlights has often been degraded by the quality of the reflector utilized and the optical characteristics of any lens interposed in the beam path. Moreover, intense light beams have often required the incorporation of as many as seven dry cell batteries in series, thus resulting in a flashlight having significant size and weight.

Efforts at improving such flashlights have primarily addressed the quality of the optical characteristics. The production of more highly reflective, well-defined reflectors, which may be incorporated within such flashlights, have been found to provide a more well-defined focus thereby enhancing the quality of the light beam produced. Additionally, several advances have been achieved in the light admitting characteristics of flashlight lamp bulbs.

Since there exists a wide variety of uses for hand-held flashlights, the development of the flashlight having a variable focus, which produces a beam of light having a variable dispersion, has been accomplished. However, such advances have heretofore been directed at "full-sized" flashlights.

In a flashlight which is made of metal body such as aluminum many manufacturing processes are necessary to ensure that effective electrical conductivity and contact can be maintained through the metal body. These processes can be relatively expensive steps in the overall manufacturing procedures. Some of these processes require multiple machining, anodizng and degreasing steps of the various metal elements. Moreover, it is desirable to ensure that the electrical conductivity between conductive elements does not deteriorate due to corrosion effects which may be caused by electrolysis through the interaction between different kinds of metal, such as copper and aluminum, which may form part of the electrical circuit.

SUMMARY OF THE INVENTION

It is an object of the present invention to provide a flashlight having improved electrical conductivity and optical characteristics.

It is another object of the present invention to provide a flashlight which is capable of producing a beam of light having a variable dispersion.

It is further object of the present invention to provide a flashlight wherein relative motions of components that produce the variation and the dispersion of the light beam provide an electrical switch function to open and complete the electrical circuit of the flashlight.

According to the invention a flashlight includes a barrel with an internal cylindrical sleeve containing at least two dry cell batteries as disposed in a series arrangement. A lamp bulb holder assembly includes electrical conductors for making electrical contact between electrodes of a lamp bulb held therein and the cylindrical sleeve in the barrel and an electrode of the battery, respectively. A tail cap and spring member encloses one end of the barrel and through the remote end of the sleeve at the tail cap provides an electrical contact to the other electrode of the batteries.

A head assembly which includes a reflector, a lens, and a face cap, is rotatably mounted to the barrel such that the lamp bulb extends through a hole in the center of the reflector within the lens.

Preferably, the batteries are of the size commonly referred to as "pen light" batteries.

The sleeve is of non-ferrous material such as brass and is nickel-plated. This ensures effective conductivity with engaging adjacent parts connected in electrical circuit with the battery electrodes and the spring member in the tail cap.

The head assembly engages threads formed on the exterior of the barrel such that rotation of the head assembly about the axis of the barrel changes the relative displacement between the lens and the lamp bulb. When the head assembly is fully rotated onto the barrel, the reflector pushes against the forward end of the lamp holder assembly causing it to shift rearward within the barrel against the urging of the spring contact at the tail cap. In this position, the electrical conductor within the lamp holder assembly which completes the electrical circuit from the lamp bulb to the barrel is not in contact with the cylindrical sleeve or barrel.

Upon rotation of the head assembly in a direction causing the head assembly to move forward with respect to the barrel, pressure on the forward surface of the lamp holder assembly from the reflector is relaxed enabling the spring contact in the tail cap to urge the batteries and the lamp holder assembly in a forward direction. This brings the electrical conductor into contact with the cylindrical sleeve, thereby completing the electrical circuit and causing the lamp bulb to illuminate. At this point, the lamp holder assembly engages a stop which prevents further forward motion of the lamp holder assembly with respect to the cylindrical sleeve and barrel. Continued rotation of the head assembly in a direction causing the head assembly to move forward relative to the barrel causes the reflector to move forward relative to the lamp bulb. This changes the focus of the reflector with respect to the lamp bulb, which results in varying the dispersion of the light beam admitted through the lens.

By rotating the head assembly until it disengages from the barrel, the head assembly may be placed, lens down, on a substantially horizontal surface and the tail cap and cylindrical tube may be vertically inserted therein to provide a "table lamp."

DETAILED DESCRIPTION

Figure 1:
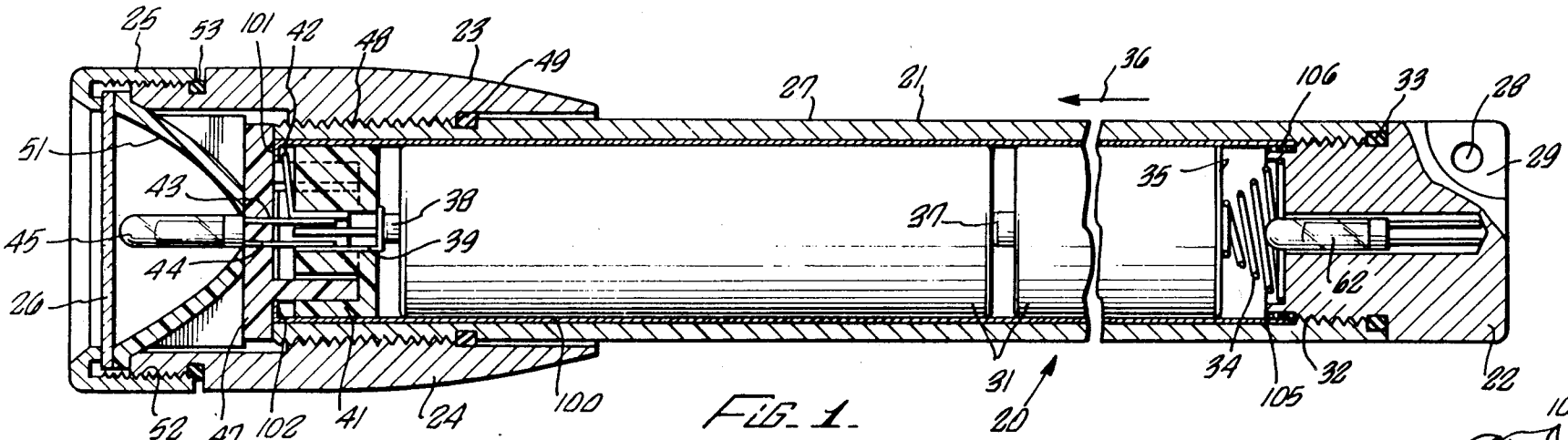
FIG. 1 is a partially foreshortened cross-sectional view of a flashlight with an internal cylindrical sleeve.

The overall construction of the flashlight of FIGS. 1, 2, 4 and 5 is basically similar. In the embodiments of FIGS. 1, 2, 4 and 5, there is an internal cylindrical sleeve. The construction of the flashlight is now described.

A flashlight 20 is comprised of a generally right circular cylinder, or barrel 21, enclosed at a first end by a tail cap 22 and having a head assembly 23 enclosing a second end thereof. The head assembly comprises a head 24 to which is affixed a face cap 25 which retains a lens 26. The head assembly 23 has a diameter greater than that of the barrel 21 and is adapted to pass externally over the exterior of the barrel 21. The barrel 21 provides a machined handle surface 27 along its axial extent. The tail cap 22 is configured to include provision for attaching a handling lanyard through a hole 28 in a tab 29 formed therein.

The barrel 21 has an extent sufficient to enclose at least two miniature dry cell batteries 31 disposed in a series arrangement. The tail cap 22 has a region of external threading 32 which engages matching threads formed on the interior surface of the barrel 21. A sealing element 33, typically in the form of an O-ring, is provided at the interface between the tail cap 22 and the barrel 21 to provide a watertight seal. A spring member 34 is disposed within the barrel 21 so as to make electrical contact with the tail cap 22 and a case electrode 35 of an adjacent battery 31. The spring member 34 also urges the batteries 31 in a direction indicated by an arrow 36. A center electrode 37 of the rearmost battery 31 is in contact with the case electrode of the forward battery 31. The center electrode 38 of the forward battery is urged into contact with a first conductor 39 mounted within a lower insulator receptacle 41. The lower insulator receptacle 41 also has affixed therein a side contact conductor 42. Both the center conductor, 39 and the side contact conductor 42 pass through holes formed in the lower insulator receptacle in an axial direction, and both are adapted to frictionally receive and retain the terminal electrodes 43 and 44 of a miniature bi-pin lamp bulb 45.

Figure 3:
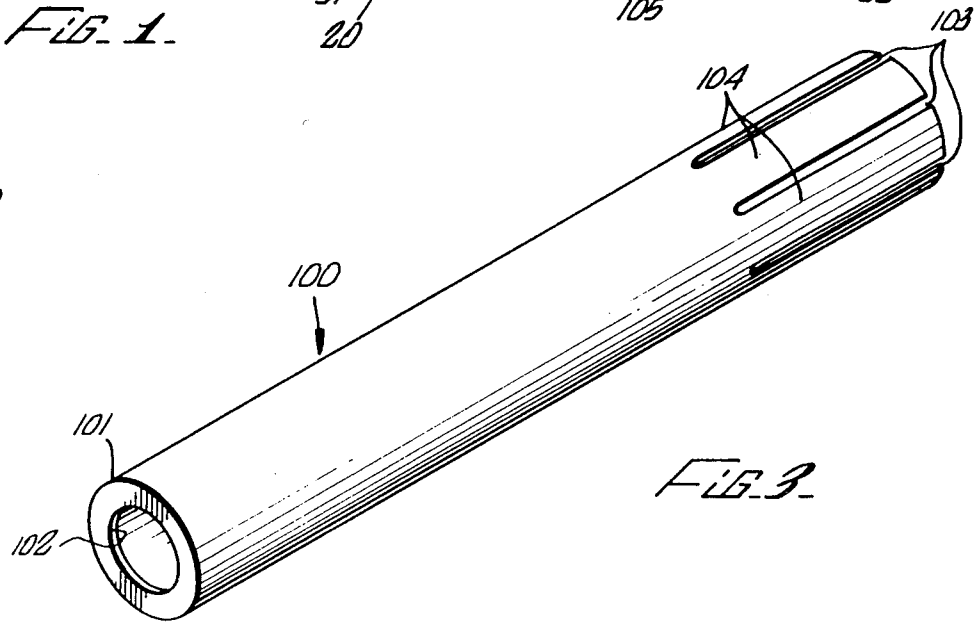
FIG. 3 is a perspective view of a cylindrical internal sleeve for the flashlight.

In FIG. 3 there is illustrated a cylindrical sleeve 100 for location internally inside barrel 21 around the batteries 31. The forward end 101 of the sleeve 100 includes an internally directed circumferential lip 102. The action of the spring 34 is thus to cause contact with the lip 102 of the sleeve 100.

The sleeve 100 is of a non-ferrous material such as brass and is nickel-plated. As the remote end, for location adjacent the tail cap 22 there are spaced slots 103 axially directed to form fingers 104 of a leaf spring. The tail cap 22 includes an inwardly directed annular slot 105 about the periphery of the tail cap 22 adjacent the second electrode of the battery 31. The annular slot 105 accommodates a portion of a spring member 106 so that the fingers 104 of the leaf spring engage the spring member 106 in annular slot 105.

The lower insulator receptacle is urged in the direction indicated by the arrow 36, by the action of the spring 34, to move until electrical contact is made between the side contact conductor 42 and the lip 102 of the sleeve 100.

An upper insulator receptacle 47 is disposed external to the end of the barrel 21 whereat the lower insulator receptacle 41 is installed. The upper insulator receptacle 47 has extensions that are configured to mate with the lower insulator receptacle 41 to maintain an appropriate spacing between opposing surfaces of the upper insulator receptacle 47 and the lower insulator receptacle 41. The lamp electrodes 43 and 44 of the lamp bulb 45 pass through the upper insulator receptacle 47 and into electrical contact with the center conductor 39 and the side contact conductor 42, respectively, while the casing of the lamp bulb 45 rests against an outer surface of the upper insulator receptacle 47.

The head assembly 23 is installed external to the barrel 21 by engaging threads 48 formed on an interior surface of the head 24 engaging with matching threads formed on the exterior surface of the barrel 21. A sealing O-ring 49 is installed around the circumference of the barrel 21 adjacent the threads to provide a watertight seal between the head assembly 23 and the barrel 21. A substantially parabolic reflector 51 is configured to be disposed within the outermost end of the head 24, whereat it is rigidly held in place by the lens 26 which is in turn retained by the face cap 25 which is threadably engaged with threads 52 formed on the forward portion of the outer diameter of the head 24. An O-ring 53 may be incorporated at the interface between the face cap 25 and the head 24 to provide a water-tight seal.

When the head 24 is fully screwed onto the barrel 21 by means of the threads 48, the central portion of the reflector 51 surrounding a hole formed therein for passage of the lamp bulb 45, is forced against the outermost surface of the upper insulator receptacle 47, urging it in a direction counter to that indicated by the arrow 36.

The upper insulator receptacle 47 then pushes the lower insulator receptacle 41 in the same direction, thereby providing a space between the forwardmost surface of the lower insulator receptacle 41 and the lip 102 of the sleeve 100 in the embodiments on the forward end of the barrel 21. The side contact conductor 42 is thus separated from contact with the lip 102 on the sleeve 101.

Appropriate rotation of the head 24 about the axis of the barrel 21 causes the head assembly 23 to move in the direction indicated by the arrow 36 through the engagement of the threads 48. Upon reaching the relative positons indicated in FIG. 2 by the solid lines, the head assembly 23 has progressed a sufficient distance in the direction of the arrow 36 such that the reflector 51 has also moved a like distance, enabling the upper insulator receptacle 47 and the lower insulator receptacle 41 to be moved, by the urging of the spring 34 translating the batteries 31 in the direction of the arrow 36.

In this position, the side contact conductor 42 has been brought into contact with the lip 102 of the sleeve 100 at the forward end of the barrel 21, which closes the electrical circuit.

Figure 2:
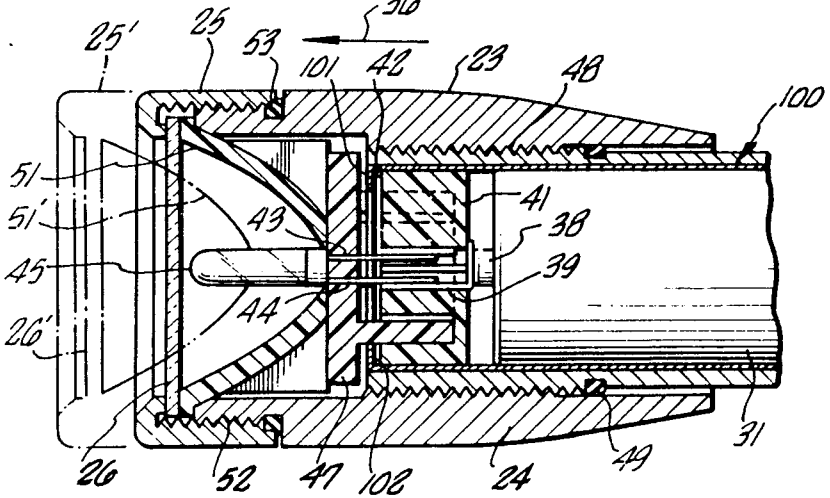
FIG. 2 is a partial cross-sectional view of a forward end of a flashlight of FIG. 1, illustrating, in ghost image, a translation of the forward end of the flashlight.

Further rotation of the head assembly 23 so as to cause further translation of the head assembly 23 in the direction indicated by the arrow 36 will result in the head assembly 23 reaching a position indicated by the ghost image of FIG. 2, placing the face cap at the position 25' and the lens at the position indicated by 26', which in turn carries the reflector 51 to a position 51'. During this operation, the upper insulator receptacle 47 remains in a fixed position relative to the barrel 21. Thus the lamp bulb 45 also remains in a fixed position. The shifting of the reflector 51 relative to the lamp bulb 45 during this additional rotation of the head assembly 23 produces a relative shift in the position of the filament of the lamp bulb 45 with respect to a focus of the parabola of the reflector 51, thereby varying the dispersion of the light beam emanating from the lamp bulb 45 through the lens 26.

Figure 4:
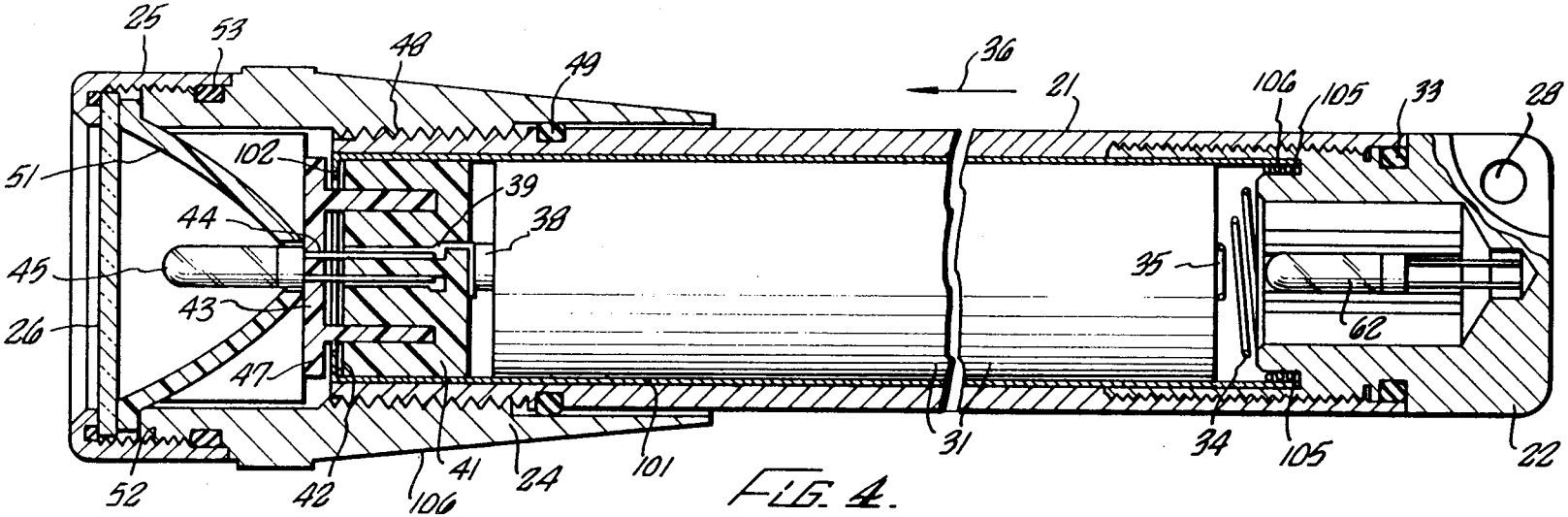
FIG. 4 is a partial foreshortened cross-sectional view of a flashlight with an internal cylindrical sleeve and with a head assembly having a gradually tapering outside surface.

In the embodiment of FIG. 4, the head assembly 23 is shaped in a gradual taper 106 towards the tail cap 22 over an extent substantially greater than half the length of the head assembly 23. The taper 106 is substantially even and gradual.

Figure 5:
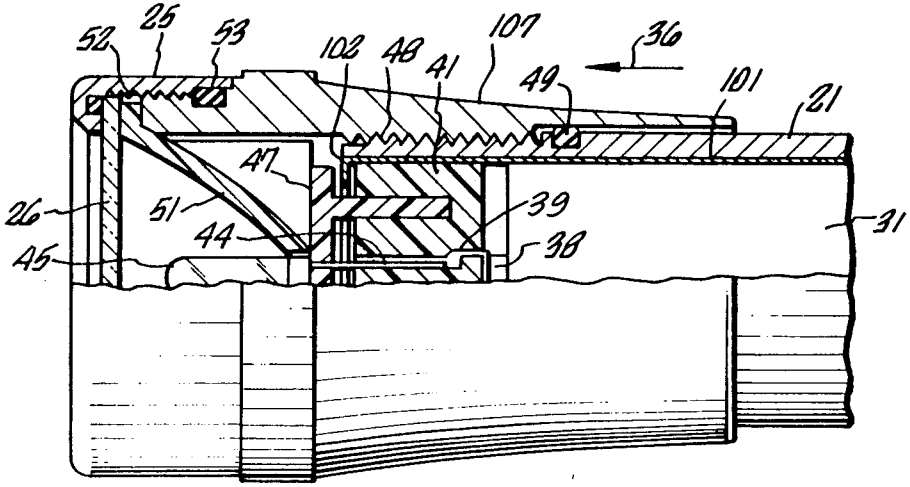
FIG. 5 is a partial foreshortened cross-sectional view of a portion of a flashlight with an internal sleeve and with a head assembly having a gradually tapering concave outside surface.

In the embodiment of FIG. 5, the head assembly 23 is shaped in a gradual concave taper 107 towards the tail cap 22 over an extent substantially greater than half of the length of the head assembly 23. The taper 107 is a substantially evenly directed concave formation.

Referring to the embodiments of FIGS. 4 and 5, the electrical circuit of the flashlight is described. The embodiments of FIGS. 4 and 5 operate in the same way as does the embodiment shown in FIG. 1. Electrical energy is conducted from the rearmost battery 31 through its center contact 37, not shown in FIGS. 4 and 5 which is in contact with the case electrode of the forward battery 31. Electrical energy is then conducted from the forward battery 31 through its center electrode 38 to the center contact 39 which is coupled to the lamp electrode 44. After passing through the lamp bulb 45, the electrical energy emerges through the lamp electrode 43 which is coupled to the side contact conductor 42. When the head assembly has been rotated about the threads 48 to the osition illustrated in FIG. 1, the side contact conductor 42 does not contact the lip 102 of the cylinder sleeve 100, thereby resulting in an open electrical circuit.

When the head assembly 23 is rotated about the threads 48 to a position further from the tail cap 22, the side contact conductor 42 is pressed against the lip 102 by the lower insulator receptacle 41 being urged in the direction of the arrow 36 by the spring 34. In this configuration, electrical energy flows from the side contact conducto 42 into the lip 102, through the sleeve 101, into spring 106 and into the tall cap 22. The spring 34 electrically couples the tall cap 22 to the case electrode 35 of the rearmost battery 31. By rotating the head assembly 23 about the threads 48 such that the head assembly 23 moves in a direction counter to that indicated by the arrow 36, the head assembly 23 is restored to the position illustrated in FIG. 1 thereby opening the electrical circuit and turning off the flashlight.

By rotating the head assembly 23 about the threads 48 in a direction causing the head assembly 23 to translate relative to the barrel 21 in the direction of the arrow 36 of the electrical circuit is closed as previously described, and the lamp bulb 45 is illuminated. Continued rotation of the head assembly 23 in that direction enables the head assembly 23 to be completely removed from the forward end of the flashlight 20. By placing the head assembly 23 upon a substantially horizontal surface such that the face cap 25 rests on the surface, the tail cap 22 of the flashlight 20 may be inserted into the head 24 to hold the barrel 21 in a substantially vertical alignment. Since the reflector 51 is located within the head assembly 23, the lamp bulb 45 omits a substantially spherical illumination, thereby providing a "ambient" light level.

In a preferred embodiment, the barrel 21, the tail cap 22, the head 24, and the face cap 25, forming all of the exterior metal surfaces of the miniature flashlight 20 are manufactured from aircraft quality, heat-treated aluminum, which is anodized for corrosion resistance. The sealing 0-rings 33, 49, and 53 provide atmospheric sealing of the interior of the flashlight 20 to a depth of 200 feet. All interior electrical contact surfaces are appropriately machined to provide efficient electrical conduction.

With the nickel-plated sleeve 100 there is effective conductivity between the various nickel components of the electrical circuit without the exposure to corrosion by electrolysis which would otherwise occur with contact between different method such as, for instance, aluminum and copper. The sleeve 100 avoids many of the manufacturing, degreasing and anodizing steps which would be otherwise necessary for the aluminum body and tail cap.

The reflector 51 is a computer generated parabola which is vacuum aluminum metallized to ensure high precision optics. The threads 48 between the head 24 and the barrel 31 are machined such that revolution of the head assembly 23 through less than ¼ turn will close the electrical circuit, turning the flashlight on. Additional turning will adjust the light beam from a "spot" to a "soft flood". A spare lamp bulb 62 may be provided in a cavity machined in the tail cap 22.

While I have described preferred embodiments of the invention, numerous modificatins, alterations, alternate embodiments, and alternate materials may be contemplated by those skilled in the art and may be utilized in accomplishing the present invention. All such alternate embodiments are considered to be within the scope of the present invention as defined by the appended claims. In one such alternative, instead of a complete cylindrical internal sleeve 100, there could be a conductive element running down the inside of the barrel 21 with a suitable contact between a lip-type formation or contact at the forward end of the barrel 21 and the side contact conductor 42 and a contact with the tail cap 22.

I claim:

1. A flashlight comprising: a barrel for retaining at least one dry cell battery; a bulb having a filament;

a means at a first end of the barrel for holding and electrically insulating the bulb from at least one battery;

a reflector;

a lens;

head assembly means threadably mounted on the barrel and for retaining the reflector and the lens adjacent the first end of the barrel, the head assembly means being adapted to be controllably axially translatable along the barrel upon rotation thereof with respect to the barrel so that the relative positional relationship between the reflector and the bulb may be varied, thereby varying a reflection dispersion of a light beam emanating through the lens from the bulb;

a tail cap engageable with the barrel at a second end of the barrel remote from the insulator assembly means;

means for electrically coupling a first electrode of the bulb to a center electrode of at least one dry cell battery;

a conductive element within the barrel to electrically couple a case electrode of at least one dry cell battery, located adjacent to the tail cap, to a second electrode of the bulb;

wherein rotation of the head assembly means in an axial direction towards the barrel causes opening of the electrical coupling of at least one electrode of the bulb with its respectively coupled battery electrode.

2. A flashlight as recited in claim 1 wherein the conductive element comprises a separate component from the barrel having different material properties.

3. A flashlight as recited in claim 2 wherein the conductive element is a cylindrical sleeve disposed within the barrel so that the batteries can be located in the sleeve.

4. A flashlight as recited in claim 1 wherein the reflector is substantially parabolic and has a central hole formed therein adapted to enable the passage of the bulb therethrough.

5. A flashlight as recited in claim 1 wherein the lens is substantially planar.

6. A flashlight comprising:

a barrel for retaining in series a plurality of flashlight batteries;

a bulb having a filament;

an insulator assembly means at a first end of the barrel for holding and electrically insulating the bulb from the batteries, adapted to locate the bulb filament axially beyond the first end of the barrel;

a substantially parabolic reflector having a central hole formed therein adapted to enable the passage of the bulb therethrough;

a substantially planar lens;

head assembly means for retaining the reflector and the lens adjacent the first end of the barrel engageable with the barrel and removably attached thereto;

a tail cap engageable with the barrel at a second end of the barrel remote from the insulator assembly means;

means for electrically coupling a first electrode of the bulb to a center electrode of the batteries;

a conductive element within the barrel adapted to electrically couple a case electrode of the batteries, located adjacent to the tail cap, to a second electrode of the bulb;

wherein relative motion of the head assembly means in an axial direction away from the barrel closes an electrical contact of one of the coupling means and further relative motion in the same axial direction separates the head assembly means from the barrel to expose the bulb and thereby permits the dispersion of substantially spherical illumination.

7. A flashlight as recited in claim 6 wherein the head assembly means is adapted to receive the tail cap and the barrel for use of the flashlight as a table lamp.

8. A flashlight comprising:

a barrel for retaining in series a plurality of flashlight batteries;

a bulb having a filament;

a coupling means at a first end of the barrel for physically and electrically coupling a first electrode of the bulb to a first battery;

a reflector;

a lens;

head assembly means threadably mounted on the barrel and for retaining the reflector and the lens adjacent the first end of the barrel, the head assembly means being adapted to be controllably axially translatable along the barrel upon rotation thereof with respect to the barrel so that the relative positional relationship between the reflector and the bulb may be varied, thereby varying a reflection dispersion of a light beam emanating through the lens from the bulb;

a tail cap engageable with the barrel at a second end of the barrel remote from the coupling means;

a conductive element within the barrel to electrically couple a second battery located adjacent to the tail cap to a second electrode of the bulb;

wherein rotation of the head assembly means in an axial direction towards the barrel causes movement of the batteries and opening of the coupling means of at least one electrode.

9. A flashlight comprising:

a barrel for retaining in series a plurality of flashlight batteries;

a bulb having a filament;

an insulator assembly means at a first end of the barrel for holding and electrically insulating the bulb from the batteries;

a reflector;

a lens;

head assembly means threadably mounted on the barrel and for retaining the reflector and the lens adjacent the first end of the barrel;

a tail cap engageable with the barrel at a second end of the barrel remote from the insulator assembly means.

means for electrically coupling a first electrode of the bulb to a center electrode of the batteries;

a conductive element within the barrel to electrically couple a case electrode of the batteries, located adjacent to the tail cap, to a second electrode of the bulb;

wherein relative motion of the head assembly means in an axial direction towards the barrel causes opening of the electrical coupling of at least one electrode of the bulb with its respectively coupled battery electrode.

* * * * *